US006186522B1

(12) United States Patent
Weis

(10) Patent No.: US 6,186,522 B1
(45) Date of Patent: Feb. 13, 2001

(54) TRAVELLING GOLF CART

(76) Inventor: Raymond P. Weis, 404 14th St. Southeast, Austin, MN (US) 55912

( * ) Notice: Under 35 U.S.C. 154(b), the term of this patent shall be extended for 0 days.

(21) Appl. No.: 08/802,998

(22) Filed: Feb. 21, 1997

(51) Int. Cl.[7] ..... B62B 1/04

(52) U.S. Cl. ..... 280/37; 280/646; 280/47.26; 280/DIG. 6

(58) Field of Search ..... 280/646, 47.19, 280/DIG. 6, 47.26, 47.24, 47.17, 37, 645, 652, 655, 47.18

(56) References Cited

U.S. PATENT DOCUMENTS

| | | | | |
|---|---|---|---|---|
| 1,955,463 | * | 4/1934 | Lathrop | 280/DIG. 6 |
| 2,577,290 | * | 12/1951 | Underwood | 280/DIG. 6 |
| 2,590,178 | * | 3/1952 | Jamison | 280/DIG. 6 |
| 2,681,232 | * | 6/1954 | Womack | 280/DIG. 6 |
| 2,760,782 | * | 8/1956 | Hartzell | 280/DIG. 6 |
| 2,992,012 | * | 7/1961 | Herold | 280/DIG. 6 |
| 3,489,426 | * | 1/1970 | Bond | 280/DIG. 6 |
| 3,620,546 | * | 11/1971 | Anderson | 280/DIG. 6 |
| 3,883,150 | * | 5/1975 | Varela | 280/47.19 |
| 3,900,209 | * | 8/1975 | McDonnell | 280/DIG. 6 |
| 3,941,398 | * | 3/1976 | Nelson | 280/DIG. 6 |
| 4,012,051 | * | 3/1977 | Embinder | 280/47.19 |
| 4,629,202 | * | 12/1986 | Nelson et al. | 280/DIG. 6 |
| 4,836,565 | * | 6/1989 | Catalo | 280/47.26 X |
| 4,890,856 | * | 1/1990 | Mursch et al. | 280/DIG. 6 |
| 5,390,944 | * | 2/1995 | Sherwin | 280/47.35 |
| 5,868,247 | * | 2/1999 | Schrader | 280/DIG. 6 |

* cited by examiner

*Primary Examiner*—Michael Mar
(74) *Attorney, Agent, or Firm*—Moore & Hansen

(57) ABSTRACT

A combination self-contained golf club bag/cart/shipping container combines all three functions in a single hard-shell unit. An array of downwardly converging tubes mounted in bulkheads of lightweight foamed or reticulated plastic hold the clubs, and an extendable cart with chassis, together with a towing handle is completely foldable into the orthorhombic case.

18 Claims, 8 Drawing Sheets

TRAVELLING GOLF CART

BACKGROUND OF THE INVENTION

This invention relates generally to carriers for golf clubs. More particularly, this invention pertains to a combination golf club carrier/cart transportable by plane, car, common carrier and the like.

The conventional golf bag is formed of a flexible fabric, leather, or plastic sheet. The bag is unsuitable for the safe shipment of golf clubs by airplane, bus, truck, automobile or other carrier because the clubs are not adequately protected and the bag itself is prone to puncture, tearing or other damage. In addition, the typical golf bag has a non-orthorhombic shape, making it difficult to stack in a baggage compartment or automobile trunk.

The numbers and sizes of golf club heads are critical factors in determining the width and depth dimensions of a golf club container. Golfers prefer to have sufficient separation of club heads during play to enable a quick grasping and removal of a club from the container. For shipping golf clubs, however, a container of minimum size is desirable. Thus, there are two conflicting ends in view which have not been satisfactorily addressed in the prior art. Most golf club containers are excessively large and heavy, contain much wasted space, and have complex shapes with many projections.

In addition, the protection of golf clubs during shipment requires careful consideration. Damage to clubs (as well as the bag) may occur during shipment because of heavy or sharp objects which puncture or crush the bag. In addition, when the clubs rub against hard materials, lengthy periods of vibration result in frictional damage to the clubs, and more particularly, to the heads of the "woods", and to club grips and shafts. Club heads and shafts formed of graphite are particularly susceptible to such visual and structural damage.

The above indicated problems encountered in travelling with golf clubs are well known. Even the nearest golf course requires automobile travel for nearly all golfers, and many people travel long distances by airplane for the purpose of golfing.

Several forms of golf club containers and bag covers are shown in the prior art having as an end the easing of problems associated with the transportation of golf clubs.

U.S. Pat. No. 4,522,299 of Clark et al. discloses a wheeled golf bag with corrugated club separators. The wheels and a handle may be partially retracted into depressions in the sides of the bag; about one-half of each wheel projects from the bag. The bag has a complex non-orthorhombic shape.

A major problem with the known varieties of combination bag/cart/container is the lack of sufficient spacing between the wheels for convenient traversal of the hillsides, dips, bumps and uneven ground typical of golf courses. Narrowly spaced wheels result in instability and necessitate careful maneuvering to prevent the apparatus from tipping sideways. Widely-spaced wheels are required for stability. The incorporation of widely spaced wheels which completely collapse into the outline of a shippable club container is an unsolved problem to date.

In addition, some forms of combination containers have rollers, wheels or balls which may operate on hard flat surfaces but not on the fairways of golf courses.

Despite all of the golf bag/cart developments whose end is protection during transportation and improvement in use, the standard approach taken by the present day traveling golfer is the use of a fabric bag with an enclosing cover for club shipment, and subsequent use of a rental cart at the golf course and to which the bag is strapped. The clubs are often poorly protected in transit, the bag with shipping cover is large and bulky, and the cover requires separate storage during play.

The need exists for a traveling golf club carrier which combines in a single unit the features of a golf bag, a cart with a wide wheel carriage, and a highly protective, easily transported shipping container.

BRIEF SUMMARY OF THE INVENTION

The primary object of this invention is to provide a golf club container with integral spaced-apart retractable wheels for convenient use in carrying a full complement of clubs for playing golf, eliminating the need for a separate golf bag and cart.

Another object of the invention is to provide a golf club container which immovably confines each club therewithin for transportation to and from the golf course or in long-distance commercial shipping.

An additional object of the invention is to provide a personal bag and cart combination which avoids the necessity for transporting a separate cart to the golf course, and also avoids the on-site rental of a golf cart.

A further object of the invention is to provide a golf club container which has uniform orthorhombic dimensions so that it may be stacked for efficient shipping by airplane, truck, train or other cartage means in a minimal space.

Another object of the invention is to provide a lightweight golf club container which may be conveniently hand carried.

An additional object of the invention is to provide a golf club container which carries a full complement of clubs in a minimum of space.

A further object of the invention is to provide a self-contained golf club container and integral cart which does not require an additional protective covering to withstand rough handling while carried in the luggage compartment of an automobile, airplane, train or other vehicle.

An additional object of the invention is to provide a combination golf club bag-cart which is quickly and easily convertible between the playing mode and transport mode.

The invention is a unitary golf club bag and cart so configured that it may travel by commercial transport or be carried in a car trunk, for example, without requiring encasement in an additional protective case. The combination club carrier/cart has an orthorhombic "envelope" in which all of the components may be enclosed for shipping. The uniform shape enables stacking of multiple units or combined stacking with other cargo. The exterior shell is formed of a tough material with a high impact strength, for protection of the golf clubs. When in the closed shipping or storage configuration, the club heads are protected against contact with hard surfaces or each other, preventing damage from vibratory or impact movements. Each club shaft is maintained in a defined location to prevent movement relative to the carrier. In the shipping/storage configuration, the unitary carrier/cart/container has no external projections beyond the orthorhombic outline of the exterior shell.

The apparatus includes a pair of wheels, each of which is mounted on a carriage which pivots about a transverse axle. Each wheel and the carriage extend forwardly and laterally to produce widely separated wheels for operating stability. The articulated wheels and carriage retract into the rigid or semi-rigid outer shell. A projecting cart handle is also retractable into the shell. A removable hinged cover with internal padding protects the club heads during shipment. In the retracted mode, the shell acts as a shipping case to protect the clubs from damage. The club handles fit into an array of elongate tubes which converge downwardly and inwardly between the retracted wheels. One or more transverse bulkheads within the shell surround portions of the tubes and retain the golf club handle tubes in the desired position. The combined bulkhead(s) and tubes form a strong interior body which resists crushing and distortion, thus reinforcing the golf club carrier. In a preferred embodiment, the case is formed of a strong molded plastic material and the bulkhead is formed of a lightweight foamed or reticulated plastic material. The case, bulkheads, wheels and carriage are joined with a minimum of fasteners to form a strong rigid or semirigid assembly which may withstand high impact forces.

Various features, embodiments and advantages of the invention will be readily understood by a reading of the following description in conjunction with the accompanying figures of the drawings wherein like reference numerals have been applied to designate like elements throughout the several views.

BRIEF DESCRIPTION OF THE DRAWINGS

In the accompanying drawings:

FIG. 1 is a partially cutaway side view of a combination bag/cart/container of the invention in the extended configuration for playing golf;

DESCRIPTION OF THE PREFERRED EMBODIMENTS

Figure 2:
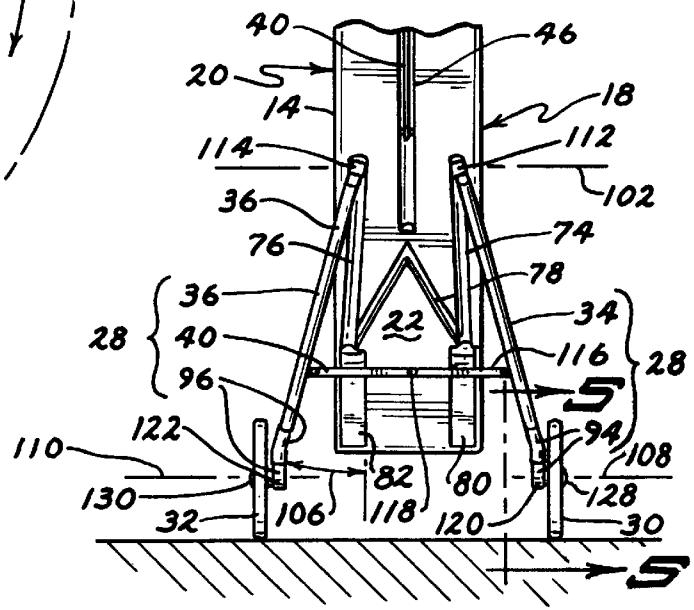
FIG. 2 is a front view of the extended carriage and wheels of a combination golf club bag/cart/container of the invention.

With reference to the drawings, and particularly to FIGS. 1 and 2, a unitary golf club carrier 10 of the invention is shown which has the functions of a golf bag, cart, and shipping container. The carrier 10 is shown in an expanded configuration for use on a golf course. The carrier 10 has an outer skin or shell 12 which covers a lower body portion 14 and a cover 16. The shell 12 has an outside surface 11 and an inside surface 13, and the shell 12 includes opposing parallel left and right side panels 18 and 20, front panel 22 with parallel rear panel 24, and bottom panel 26.

A foldable carriage 28 carries left and right wheels 30 and 32 on left strut 34 and right strut 36, respectively. The carriage 28 opens forwardly from a retracted position in recesses 74, 76 and 78 within the shell 12, and the wheels 30, 32 are extendable outwardly from retracted positions within wheel recesses 80, 82 (See FIG. 2) opening inwardly from the front panel 22. When the carriage 28 is fully opened, the wheels 30, 32 are located to the sides of the lower body portion 14. The stability of the wheeled carrier is much increased by use of the wide wheel separation. In addition, when operating the wheeled carrier through puddles, wet grass and the like, there is less likelihood of wheel spray entering the wheel recesses 80, 82.

A retractable playing handle 38 is pivotally attached to, and projecting forwardly from the front panel 22 of the lower body portion 14 for pulling the rolling carrier 10 during play. The handle 38 is shown with an attached support member 40 which secures the handle in the extended position. As illustrated, support member 40 folds at a central hinge 42 for collapsing the handle 38 and support member 40 downward and rearward about pivot point 44 into an elongate recess 46 in the front panel 22 of the lower body portion 14.

Some golfers prefer to carry their bags rather than roll them on a cart. A carrying strap 84 for toting the carrier on a person's shoulder is shown in FIG. 1 as movable between an outer carrying position and a retracted position in elongate recess 86 in the rear panel 24 of the carrier 10. The shoulder strap 84 is shown as passing on the inside of roller 87 and is biased toward the retracted position by a spring, not shown, which draws the strap into the lower body portion 14 and the recess 86. In the preferred configuration, the strap 84, once pulled out to the carrying position, may be locked in that position. Thus, it is not necessary to pull the strap 84 from the recess each time a golfer moves to the next shot. Of course, the golfer has the option at any time of rolling the carrier 10 on its wheels if carrying the carrier by its shoulder strap 84 is not desired. In a further preferred configuration, the strap 84 is openable to a full or partial open position and lockable in that position, enabling comfortable toting either on the shoulder or by one's hand. The strap 84 may have an upper, central or lower portion which is relatively stiff relative to the remainder of the strap, so that once opened, the strap tends to remain in an open, readily accessible position.

Figure 4:
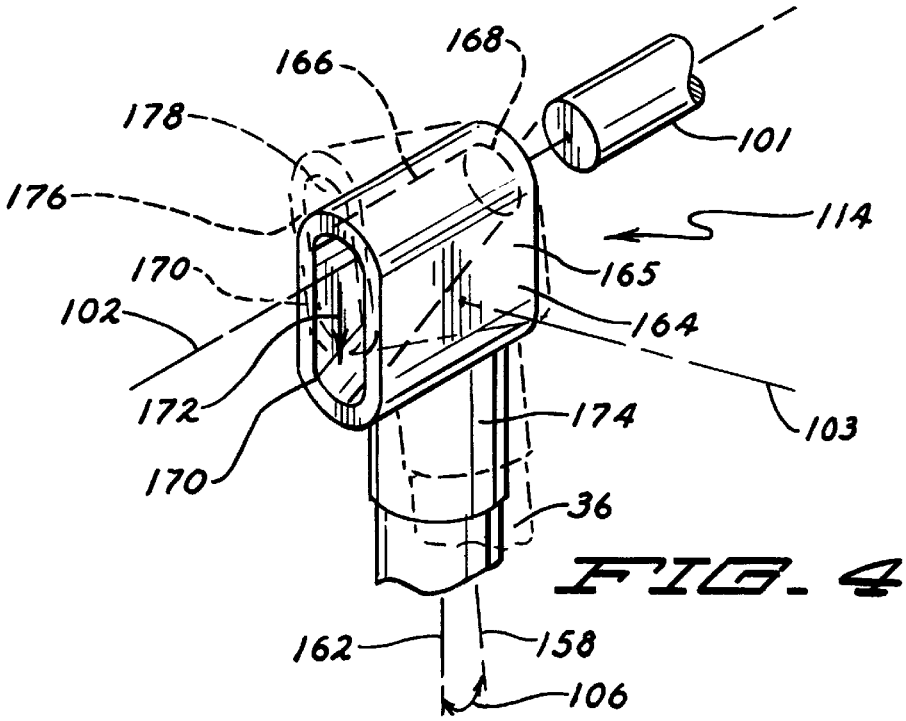
FIG. 4 is a perspective view of the upper end of a strut with a strut hub in accordance with an exemplary embodiment of a bag/cart/container of the invention.

FIG. 4 shows the carrier cover 16 as fitted with a recessed handle 88 on its top panel 58. The handle 88 is biased to remain within recess 90 unless pulled outward therefrom. If desired, another similarly sized handle may be installed within a recess, not shown, in one of the sides or the rear of the shell 12.

All of the recesses in the shell 12 are configured to completely enclose the retracted parts so that none of the retracted parts extends outwardly beyond the exterior outline of the shell 12. Thus, the integral orthogonal shape of the self-contained golf club bag/cart/container 10 is maintained upon full retraction of the carrier 12 for transport in automobiles, or for storage.

Figure 7:
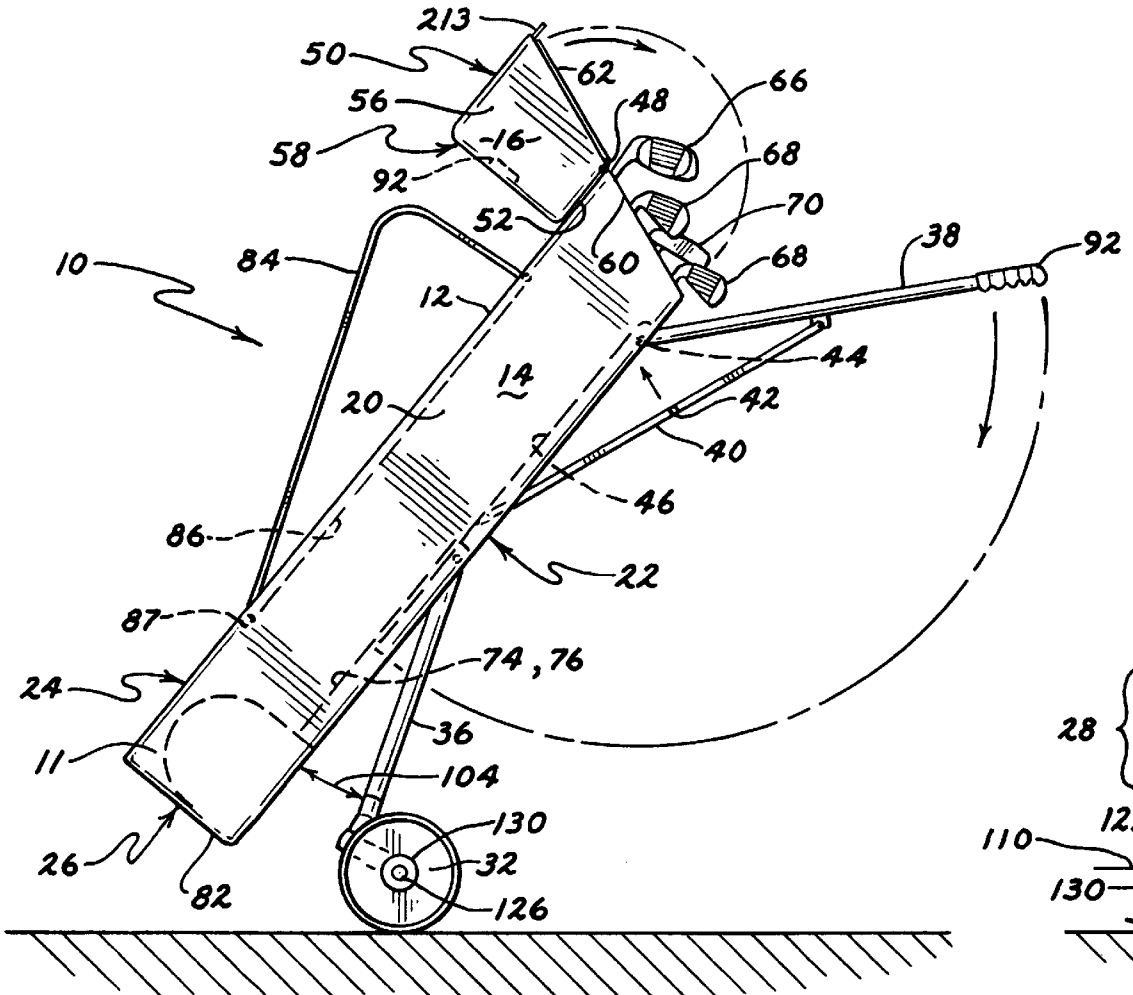
FIG. 7 is a partially cutaway perspective view of a combination golf club bag/cart/container of the invention in a retracted configuration useful for transportation or storage.
Figure 10:
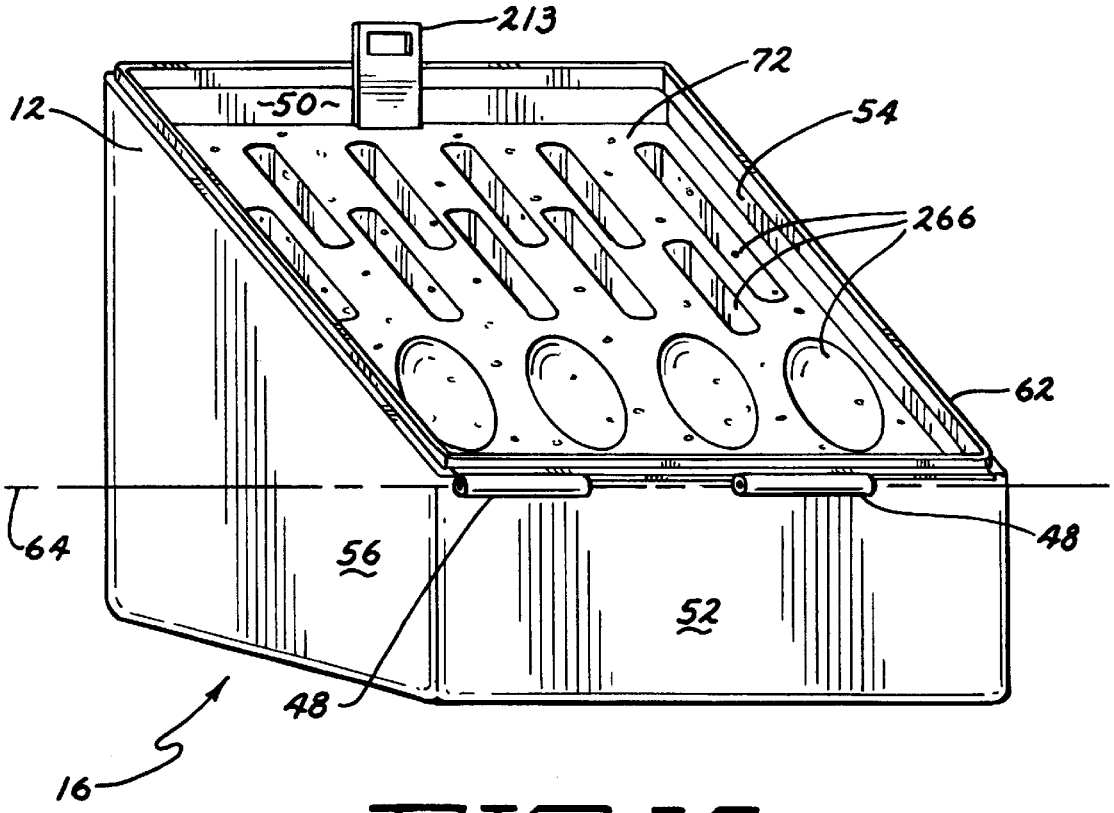
FIG. 10 is a perspective view of the interior of an inverted cover of an exemplary embodiment of a combination bag/cart/container of the invention.

Looking at FIG. 1 in conjunction with FIGS. 7 and 10, the cover 16 is depicted as rotatably connected to the lower body portion 14 by hinge 48. Preferably, the cover 16 is separable from the lower body portion 14. The cover has a front panel 50, a rear panel 52, lateral panels 54, 56 and top panel 58. The panels comprise a portion of the hard skin or shell 12.

The shell 12 of the lower body portion 14 has an upper edge 60 which engages the lower edge 62 of the cover 16 (see FIG. 10) when the cover is closed. A sealing material, not shown, such as foam rubber may be installed within the cover 16 to interact with upper edge 60 to seal the interface against the entrance of dirt and dust, etc. If desired, construction of the apparatus may include a tight seal for excluding water. When the playing clubs including "woods" 66, "irons" 68 and putter 70 (and/or other non-conventional clubs) are placed in the carrier 10 and the cover 16 closed, the club heads are immobilized in padding 72 within the cover 16.

In this discussion, the front panel 50 of the apparatus is designated as the portion from which the playing handle 38 projects for rolling the carrier 10 on the playing surface. The handle 38 is shown with a grip 92 for hand manipulation.

Turning to FIG. 2, a front view is presented showing the carriage 28 with left and right wheels 30 and 32, respectively, rotatably attached thereto. In this embodiment, the carriage includes an elongate left strut 34 having a lower end assembly 94 connected to left wheel 30. Likewise, an elongate right strut 36 has a lower end assembly 96 connected to right wheel 32. The end assemblies 94, 96 each includes a knuckle or swivel arm 120, 122 which rotates relative the strut 34, 36, respectively. Each swivel arm 120, 122 carries a wheel axle 124, 126 (see FIGS. 1 and 6) which passes through a central hub 128, 130 on wheel 30, 32, respectively.

The opposing or upper ends 98, 100 of the struts 34, 36 are fitted with hubs 112 and 114 pivotally connected to a shaft 101. (FIG. 3) The shaft 101 is mounted in the lower body portion 14 along axis 102 so that the lower end assemblies 94 and 96 of the struts 34, 36 may each pivot forwardly through an angle 104 (see FIG. 1) and pivot laterally through an angle 106 (see FIG. 2) when extended. The construction and relationship of the hubs 112, 114, upper ends 98, 100, and the shaft 101 with the shell 12 are further described, infra, with reference to FIGS. 3 and 4.

A Cross-brace 116, shown in FIG. 2, extends between struts 34 and 36, has a central lockable hinge 118, and is pivotally connected to the struts 34, 36 so that the cross-brace may fold and retract into recess 78 as the struts are retracted into elongated upright recesses 74 and 76. In the extended position, the left and right wheels 30 and 32 rotate about axes 108 and 110, respectively; these axes may be coincident. Optionally, the wheels may be configured to operate with a small amount of camber and/or toe-in (positive or negative), in which cases axes 108 and 110 are non-coincident.

Figure 3:
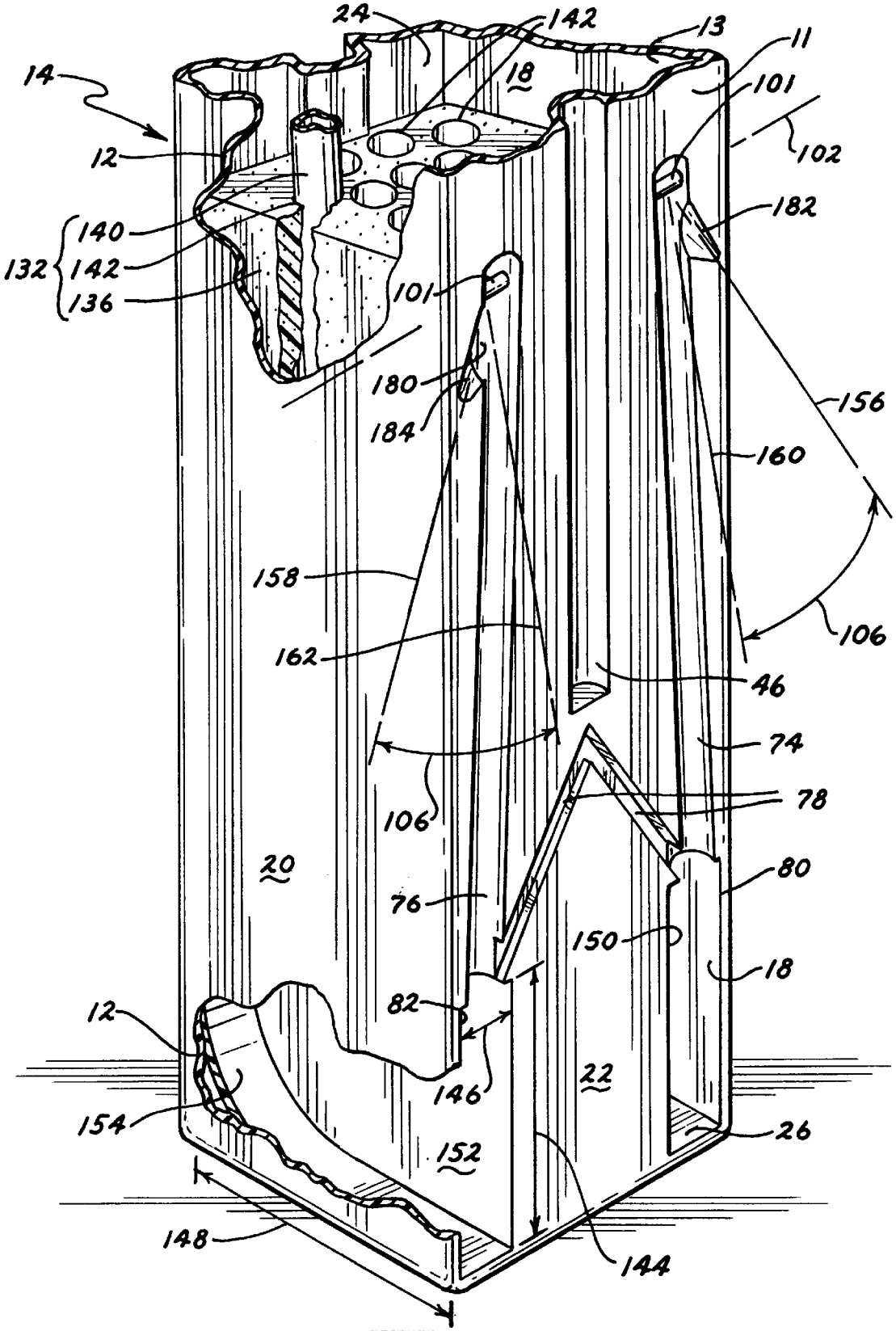
FIG. 3 is a partially cutaway perspective view of the lower portion of a combination golf club bag/cart/container of the invention.

The lower body portion 14 is shown in greater detail in FIG. 3. The shell 12 forms a hard case which encloses an interior assembly 132 of two or more separated bulkheads which define a golf club holding means. Left and right side panels 18 and 20, front panel 22, rear panel 24, and bottom panel 26 are shown. The interior assembly is illustrated in part as middle bulkhead 136 having an array of holes 142 through which are vertically passed a series of tubes 140. The interior assembly 132 is further discussed, infra, in reference to FIGS. 8–10.

The front face or panel 22 of the shell 12 is shown at FIGS. 1 and 2 with vertical recess 46 for a retracted and stored playing handle 38. Also shown are recesses 74 and 76 for receiving the retracted carriage struts 34, 36 and recess 78 for receiving the cross brace 116 when it is retracted.

In addition, wheel recesses 80, 82 comprising wheel wells are depicted as nearly spanning the width of the side panels 18, 20, each recess having sufficient width 146, height 144 and depth 148 to receive the wheel 30 or 32 with the attached lower end assembly 94 or 96. In the embodiment shown in FIG. 3, each wheel recess 80, 82 has an interior wall 150, 152, respectively, parallel to the side panels 18, 20. Interior walls 150 and 152 may be integral portions of the shell 12, or may comprise the sides 153 of a bottom bulkhead 138 (see FIG. 8). In addition, a curved rear wall may also be used, as indicated by wall 154 of recess 82.

Further details of the wheel carriage 28 become evident by comparing FIGS. 3, 4, 5, and 6. As already noted, left strut 34 is movable between a retracted position within recess 74 and an extended position having an axis shown generally as 156 (FIG. 3). Likewise, right strut 36, is movable between a retracted position within recess 76 and an extended position having an axis shown generally as 158. The struts 34, 36 not only may swing convergingly, forwardly to the positions denoted by strut axis positions 160, 162, (See FIG. 3) but are free to pivot laterally outward through angles 106 to the extended axis positions 156, 158. This lateral pivoting is accompanied by the straightening of cross-brace 116 about central hinge 118, and is made possible by two-direction swivel hubs 112, 114.

As shown in FIG. 4, right swivel hub 114 includes a hub body 164 through which a bore 166 is formed for swivelling about shaft 101 having axis 102. The bore 166 has an opening 168 which conforms to the shape and size of the shaft 101, and an opposite opening 170 which is elongated in one direction 172 to permit the hub 114 to simultaneously swivel about axis 102 as well as about an axis 103 normal to the front 165 of the hub body 164. The hub 114 is shown as having means 174 for attachment to the right strut 36. The attachment means 174 is illustrated as a ferrule into which strut 36 is fitted.

When the hub 114 and strut 36 are swivelled outwardly away from the shell 12, to the phantom position 176 of FIG. 4, the axis 162 of strut 36 swings through angle 106 to axis position 158 in which the strut 36 is fully extended to a running position.

The vertical elongation of bore 166 controls the degree of lateral swivelling. The distance which the carriage 28 may swivel or pivot forwardly from the front panel 22 may be limited. One way of achieving such limitation is, for example, by positioning the axle 101 in the recess 76 so that the rear upper surface 178 of hub 114 engages the rear wall 180 of recess 76, when the hub 114 and strut 36 are fully extended.

It should be noted that this discussion of right hub 114 also applies to left hub 112, except that the bore elongation and lateral movement of the left strut 34 are in the opposite direction.

The cross-brace 116 may be slightly elongated so that when fully extended, the cross-brace applies outward pressure on the struts 34, 36 to anchor them in the extended position.

Another feature is shown which positions the struts 34, 36 in the extended position. The shell 12 is depicted in FIG. 3 with insets 182, 184 which cup and hold the carriage struts 34, 36 in the extended position.

A further means for preventing the extended carriage 28 from swinging away from the shell 12 may comprise a strap or other member, not shown, connecting the carriage 28 to the shell 12.

The central hinge 118 on cross-brace 116 and central hinge 42 on support member 40 are preferably equipped with locking devices, known in the art, to permit locking of the member in the extended position.

Where the discussion is directed to one side of the carriage or shell, it is understood that the discussion pertains to the opposite side as a general mirror image thereof.

Figure 6:
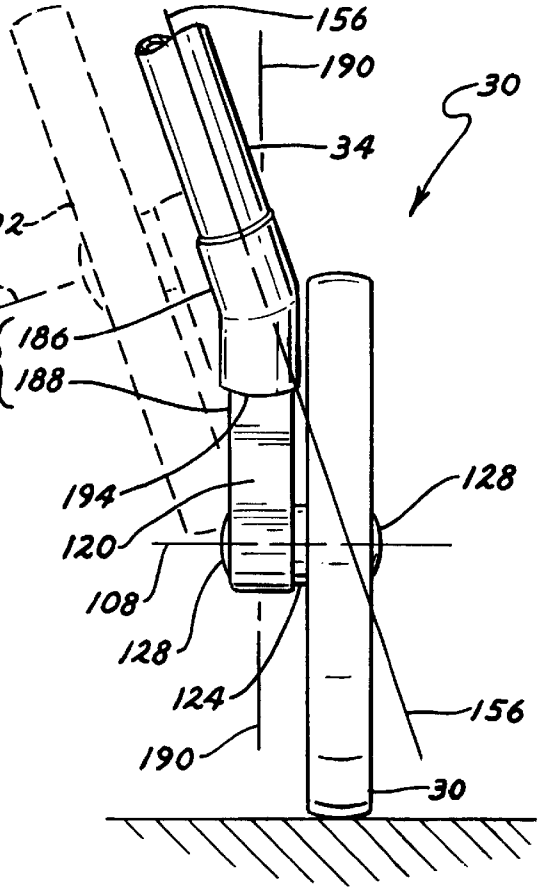
FIG. 6 is a front view of the lower portion of the carriage of an embodiment of a combination bag/cart/container of the invention, taken along line 6—6 of FIG. 5.
Figure 5:
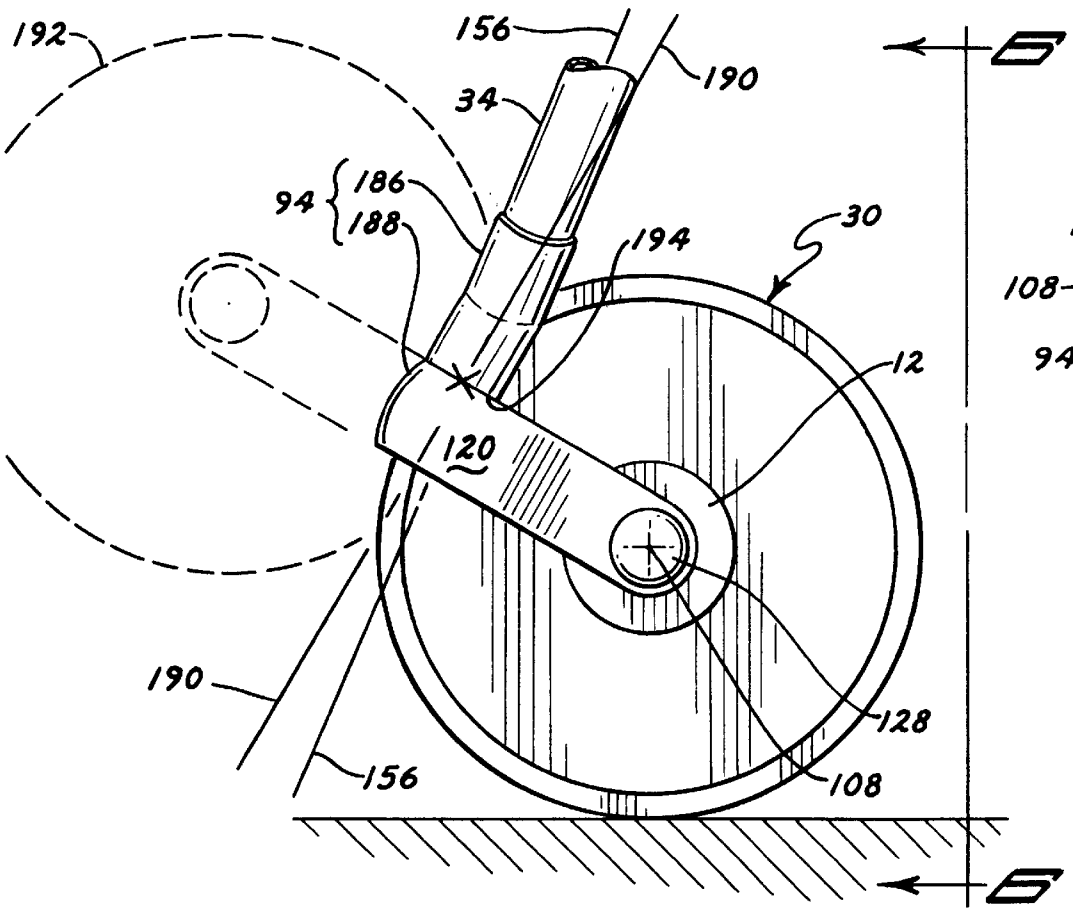
FIG. 5 is a side view of the lower portion of the carriage of an embodiment of a combination bag/cart/container of the invention, taken along line 5—5 of FIG. 2.
Figure 7:
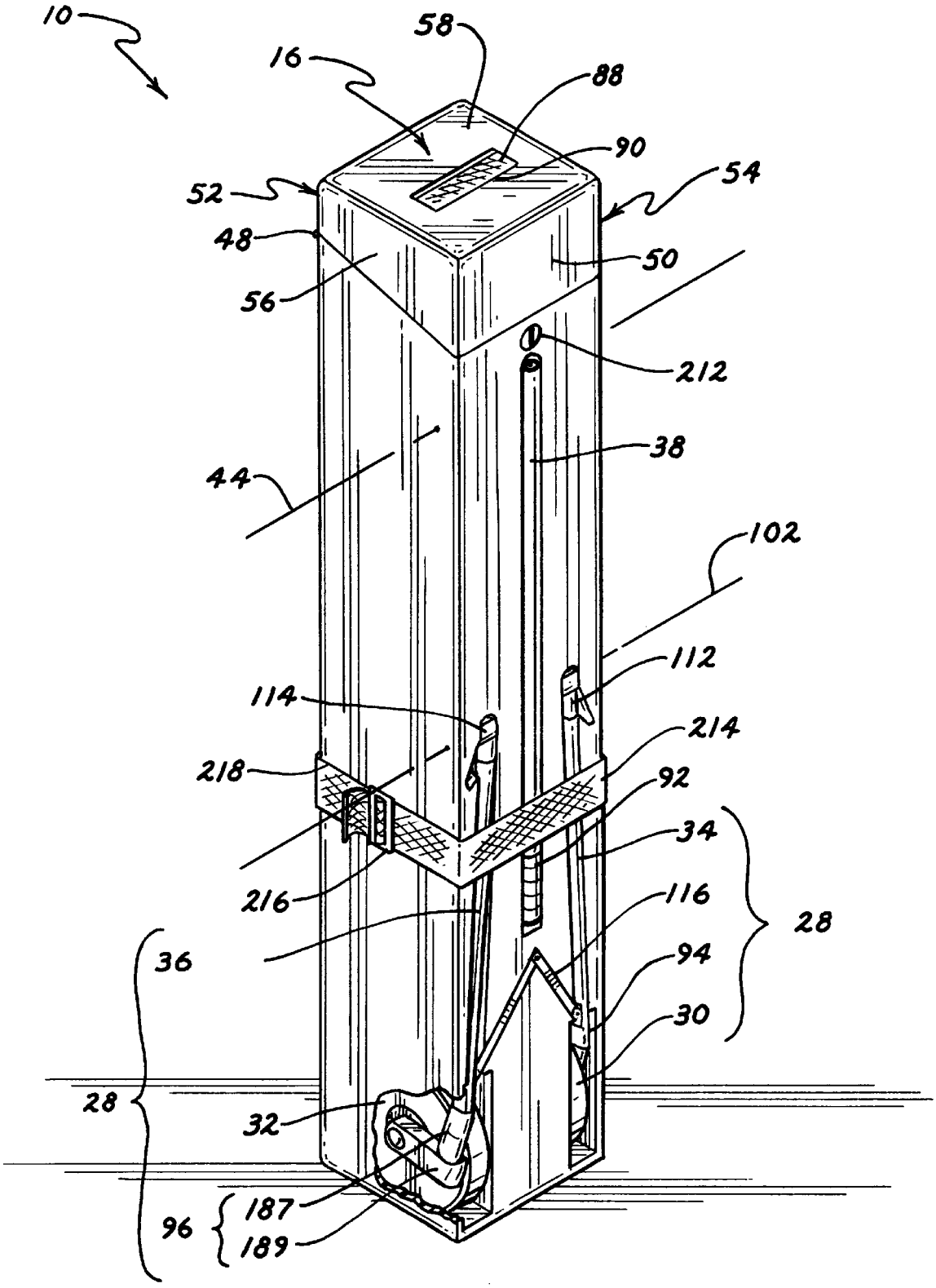

Turning to FIGS. 5 and 6, one of the wheels, i.e. left wheel 30 is depicted together with the lower end assembly 94 and lower portion of strut 34 in an extended position. As shown, the lower end assembly 94 includes a strut end 186 and a swivel arm 188. The swivel arm 188 swivels relative to strut end 186, about axis of rotation 190. Axis 190 is offset from strut axis 156 so that the wheel may be rotated from a stored position 192 parallel to the strut, to a running position shown which is vertical or nearly so. The angular offset also affects the retracted position of the wheel 30, elevating above the expanded wheel position to fit into the wheel recess 80. (FIGS. 2 and 3).

In addition, swivel arm 188 offsets the wheel axis 108 so that the retracted position of the wheel is rearward of the strut 34 and the wheel will become completely enclosed in recess 80. The offset between the wheel axis 108 and the axis 190 is roughly equal to the wheel radius or slightly less, whatever is necessary to completely recess the retracted wheel.

Figure 12:
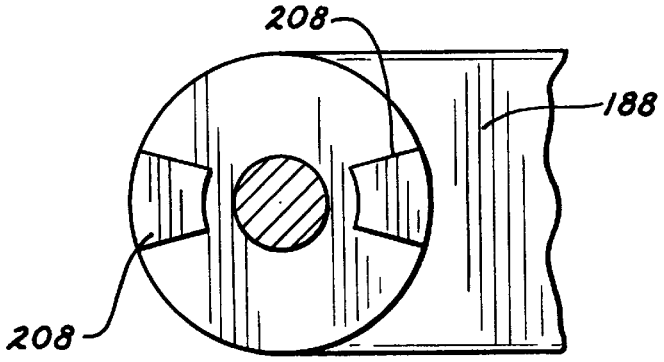
FIG. 12 is a cross-sectional plan view of a portion of the wheel carriage taken along lines 12—12 of FIG. 11.
Figure 11:
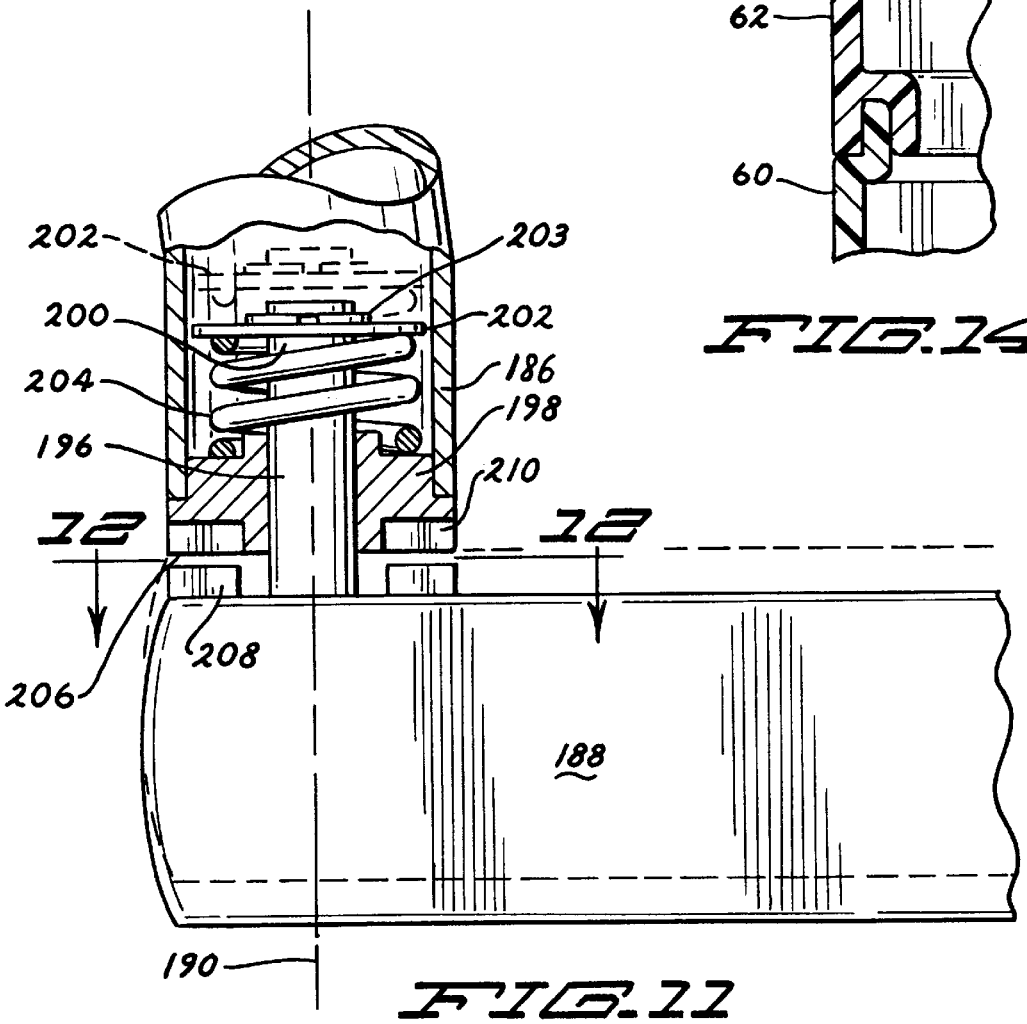
FIG. 11 is a partially sectioned lateral view of a portion of the wheel carriage of an embodiment of the invention.

The engaging interface 194 must maintain the wheel oriented forwardly for running control. Thus, the interface 194 may be discontinuous, notched, serrated or otherwise configured to prevent slippage between the swivel arm 188 and the strut end 186. The swivel arm 188 and strut end 186 may be held in tension by a spring in one of the two members. Thus, in FIGS. 11 and 12, an exemplary mechanism for retaining the arm 188 and end 186 in alignment is shown. Strut end 186 is shown as hollow. The swivel arm 188 has an upwardly extending shaft 196 coaxial with axis 190 and which passes through an endpiece 198 fixed to strut end 186. The upper end 200 of the shaft 196 carries a crosspiece 202 which holds a spring 204 in compression against the endpiece 198. The crosspiece 202 is held on the shaft 196 by retaining clip 203. At the interface 208 between swivel arm 188 and endpiece 198, projections 208 in one of the two members correspond to recesses 210 in the other member, so that they lock when engaged.

The tire may be made of a plastisol or other durable plastic material which is non-inflatable or it may be inflatable to a low pressure, i.e. less than about 15–30 psi. The tire and wheel rim are very light in weight.

In the foregoing description of one embodiment of the carriage portion of the invention, the carriage and wheels are opened to the playing mode by pulling the carriage and wheels forward from the recesses in the front panel, pulling the wheels outwardly apart to the extent allowed by the cross brace 116, pulling each swivel arm downward and rotating the wheels about axis 190 to a rotative playing mode where the wheels are positioned forward, outward, and downward from the retracted position for rotating on a golf course.

As shown in FIG. 7, the entire carriage 28, including the struts 34, 36, hubs 112, 114, lower end assemblies 94, 96, and cross brace 116, together with the wheels 30, 32, may be retracted into the casing or shell 12. Right lower end assembly 96 is shown as comprising the strut end 187 and swivel arm 189. In addition, the various handle assemblies including the playing handle 38, shoulder strap 84, and cover handle 88 are also retractable into the shell 12, so that the shell with attached cover is entirely orthorhombic in shape. The carrier 10 is shown with a lock mechanism 212 for locking the cover 16 and a shipping strap 214 with buckle 216 for shipping the container with enclosed clubs. Preferably, the lower body portion 14 includes a shallow recess 218 in which the strap 214 rests, to maintain the orthorhombic shape of the apparatus.

Figure 8:
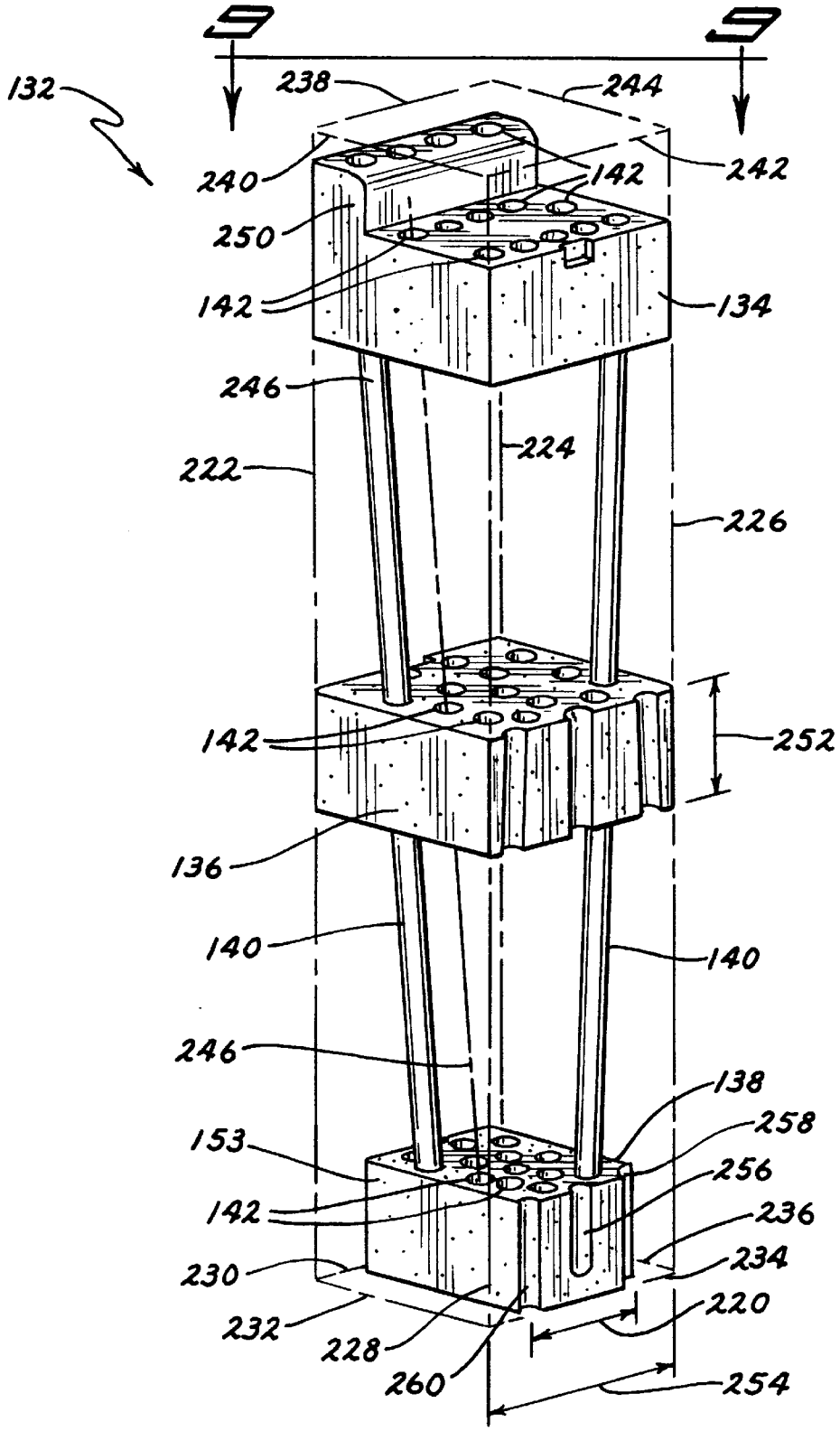
FIG. 8 is a partial perspective view of the interior construction of an exemplary embodiment of a combination bag/cart/container of the invention.

In FIG. 8, the construction features of an exemplary club holding interior body assembly 132 are shown. At least one, and preferably two or more separated bulkheads are used. As illustrated, an upper bulkhead 134, middle bulkhead 136 and lower bulkhead 138 are aligned vertically. These bulkheads may be formed of lightweight foamed or reticulated plastic material of sufficient strength to maintain the shape of the shell 12 in which they fit, yet have sufficient resilience to absorb impact shocks against the carrier skin or shell 12. The upper and middle bulkheads 134, 136 are configured to fit snugly into the interior of the shell 12 of lower body portion 14 as outlined in phantom by vertical corner lines 222, 224, 226, and 228, and by horizontal corner lines 230 through 244.

The lower bulkhead 138 is of reduced width 220 to permit running wheels 30 and 32 to be completely retracted into the shell 12 on opposite sides of the bulkhead. Typically, the reduced width 220 is about 50 to 70 percent of the full width 254 of the shell 12.

The bulkheads 134, 136 and 138 are shaped to accommodate the various recesses in the shell 12 which have already been discussed above. As depicted in FIG. 8, the exemplary lower bulkhead 138 has central recess 256 and corner recesses 258, 260 for fitting around the inside wall 13 of the shell 12 at recesses 46, 74 and 76. The other bulkheads have similar recesses depending upon the location of the bulkhead within the shell 12 and the shape of the inside wall 13 of the shell.

An array of through holes 142 pass through the upper and central bulkheads 134 and 136, and pass through or into the lower bulkhead 138. The axes 246 of the holes 142 are generally non-parallel and converge generally downwardly and inwardly to fit within the reduced upper area of the lower bulkhead 138.

Tubes 140 capable of accepting and holding the handles of golf clubs are placed in each set of axial holes 142 through the bulkhead or bulkheads. For standard golf clubs, these tubes have an inside diameter which is at least 28 mm and preferably 30–32 mm. Because of the differences in club lengths, and particularly in the lengths of the club shafts, the tube lengths for "woods" are generally greater than the lengths of tubes for "irons" or the putter. It is understood, of course, that in both woods and irons, the club lengths have an inverse relationship with the club designated number. For example, a No. 8 iron is shorter than a No. 2 iron, and both of course are generally shorter than a No. 3 wood.

Figure 9:
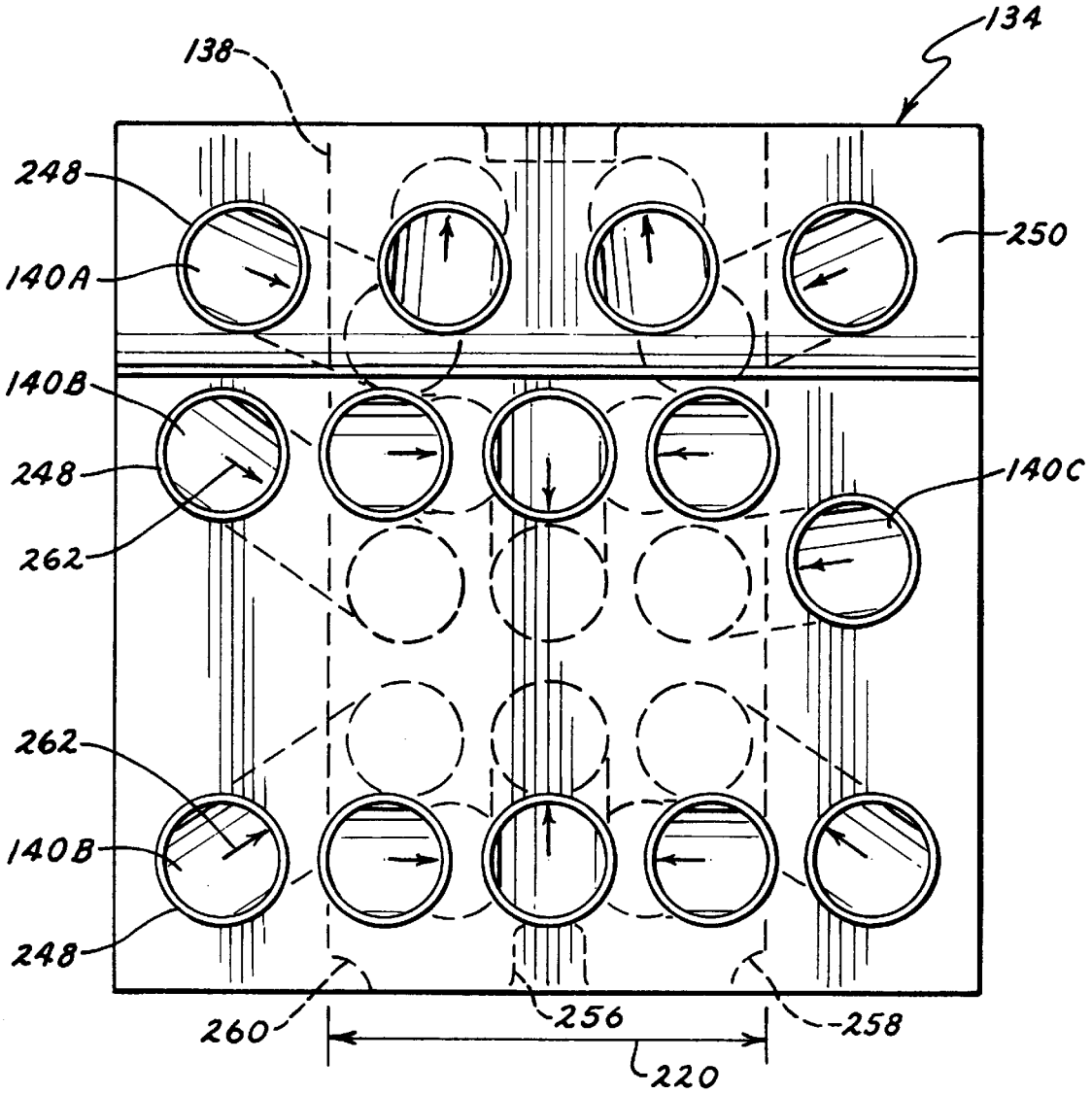
FIG. 9 is a plan view of the interior construction of an exemplary embodiment of a combination bag/cart/container of the invention, taken along line 8—8 of FIG. 7.

The embodiment of the invention shown in FIGS. 8 and 9 has four longer tubes 140A for accommodating "woods", nine shorter tubes 140B for "irons" and one short tube 140C for a putter. Of course, it is not required that the clubs be placed in the tubes in any particular order during play, but the spacing and upward divergence of the tubes 140 enhances the clearance between the clubs at their upper end for easier play and safer handling. For greatest protection during shipment of clubs, irons and putter must be placed in the shorter tubes configured for those clubs, and woods must be placed in the longer tubes configured for woods. In this way, the foam padding 72 in the cover 16 engages with each club head to hold each club, whether wood or iron, essentially immobile within the container 10.

The numbers and sizes of bulkheads used in the interior assembly 132 may be varied. The use of two or more separated bulkheads is preferred, and permits the bulkhead weight and volume to be much reduced without unduly sacrificing strength. Thus, FIGS. 8 and 9 show three bulkheads which in total occupy about one-third of the vertical space within the shell 12.

The rigidity and strength of the interior assembly 132 is enhanced by the generally non-parallel tubes 140. In FIG. 9, an arrow 262 in each tube 140A,B,C indicates the lateral direction of the tube in passing downward from the upper bulkhead 134 to the lower bulkhead 138. The arrangement of the tubes and bulkheads permits the array of tubes to converge into the smaller lower bulkhead 138 without interference with each other or the shell 12.

While these tubes 140A,B,C may be merely passed through the holes 142 in the bulkheads 134, 136 and 138, they are alternatively cemented therein to further strengthen the assembly. In addition, each bulkhead may be joined to the inside wall 13 of the shell 12 by cementation thereto, so that the interior assembly 132 and shell 12 form a singular structural body. The torsional rigidity of the assembly 132 is affected by the rigidity of the bulkhead material, the bulkhead depth 252, and the spacing between the bulkheads. For a typical foamed plastic such as foamed polyvinyl chloride, the preferred bulkhead depth 252 is at least one third of the horizontal dimension 254 of the bulkhead.

Club carriers of the invention may be adapted for carrying a greater number of clubs, if desired, by enlarging the cross-sectional dimensions to provide for additional club carrying tubes. Likewise a smaller carrier 10 may be used for carrying a lesser number of clubs. The embodiment shown in FIGS. 8 and 9 is configured to carry 14 clubs within a shell 12 having an 8-inch square cross-section.

If desired, plugs may be inserted into the lower ends of longer tubes so that shorter golf clubs placed therein will be positioned at the proper height. The plugs may be rigid or resilient. During shipment, longitudinal shock forces are primarily absorbed by the resilient materials cradling the upper and lower surfaces of the club head.

Figure 13:
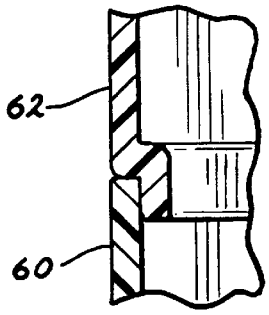
FIG. 13 is a partial, cross-sectional side view of a closure portion of the hard shell of the invention.
Figure 14:
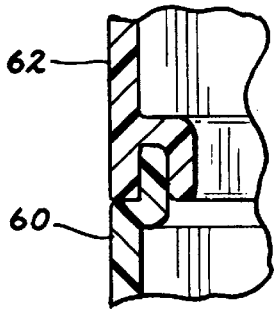
FIG. 14 is a partial, cross-sectional side view of a closure portion of the hard shell of another version of the invention.

Turning now to FIG. 10, a cover 16 is shown inverted and separated from the lower body portion 14 of the bag/cart/container of the invention. The cover 16 is shown with a partial hinge 48 attached to the thin shell 12 at the rear panel 52, enabling the cover 16 to pivot about the lower body portion 14 or to be completely removed therefrom by sliding the opened cover parallel to hinge axis 64. The edge 62 of the cover shell 12 may be shaped to interlock with the upper edge 60 (FIG. 1) of the lower body portion 14 to retard the entrance of dust, water, etc. when the container is closed. As depicted in FIGS. 13 and 14, the edge 62 or edge 60 may be offset, L-shaped or otherwise configured to provide a positive engaging interface between the edges 60 and 62. If desired a sealing member, not shown, may be secured along the interface to provide an enhanced seal. In FIG. 10, a latch 213 is shown fixed to the front panel 50 of the cover 16 for lockable engagement with the locking mechanism 212 (FIG. 7).

The cover 16 contains a soft foam padding 72 which may include cutouts 266 for each of the club heads. When the cover 16 is closed, the padding 72 cradles the club heads and prevents damage to the heads when the carrier 10 is subjected to rough handling.

As shown in FIGS. 13 and 14, the interface between edges 60 and 62 on side panels 54 and 56 (See FIG. 1) is shown as being non-perpendicular to the general axis of the container 10. Thus, the cover padding 72 (FIG. 10) within cover 16 is angled to take into account the differences in club lengths contained in the container 10. The cover/body interface may take other configurations, such as the inclusion of arcuate or stepped portions, or the interface may be wholly perpendicular to the container axis.

If desired, a soft top, not shown, may be used in place of the cover 16 during play. The soft top may be carried in the cover when the container is closed.

Locking mechanisms such as are known in the art may be incorporated into the handle 38 and cooperating recess 46, such that the retracted handle and support member 40 will remain fully retracted during shipment and storage. Likewise, the wheels 30 and 32 and carriage 28 together with the cooperating recesses 74, 76, 78, 80 and 82 may be equipped with locking devices to maintain a retracted mode, especially during rough handling. None of these locking devices is shown in the drawings, being known in various forms in the art.

It is anticipated that various changes and modifications may be made in the construction, arrangement, operation, materials and method of construction of the travelling golf club container disclosed herein without departing from the spirit and scope of the invention as defined in the following claims.

What is claimed is:

1. An integrated golf club playing bag, cart and travel container, comprising:

a generally orthorhombic hard shell having a main body portion with an upper opening with a closable and openable cover hinged to said hard shell, and a bottom, said shell defining the exterior of said bag, cart and travel container and having outwardly opening recesses therein;

means for holding a plurality of golf clubs in closely spaced relationship in the main body portion;

two laterally spaced wheels for contacting and rolling on a ground surface while supporting said shell;

an articulated carriage attached to said shell and said wheels, said carriage including two generally vertical, spaced, elongate struts having spaced-apart upper ends pivotable in vertical and lateral planes about a generally horizontal transverse axis lying within a generally central portion of said shell, and spaced-apart lower ends having said wheels swivelably joined thereto for swiveling about axes oblique to said struts, and means for rigidly connecting and retaining said two struts in a fully open position; and a golf play handle foldable into said main body portion;

wherein said carriage is manipulable between (a) an extended playing position forward of said shell and with said wheels spacedly separated laterally and forwardly from said shell and (b) a retracted position wherein said carriage and wheels are retracted into said recesses within said defined exterior, said wheels retracted into recesses adjacent said bottom of said shell at opposing sides thereof.

2. The golf club playing bag, cart and travel container of claim 1, wherein said means for holding a plurality of golf clubs comprises:

a bulkhead spanning the upper opening in the main body portion and having a plurality of downwardly directed orifices passing therethrough; and a plurality of tubular members passing downwardly through said orifices, each said tubular member configured to hold a golf club handle.

3. The golf club playing bag, cart and travel container of claim 2, wherein said plurality of tubular members generally converge to a restricted pattern in the lower portion of said main body portion.

4. The golf club playing bag, cart and travel container of claim 2, wherein said bulkhead comprises one of a rigid and semirigid expanded plastic member.

5. The golf club playing bag, cart and travel container of claim 2, wherein said bulkhead spanning the upper opening comprises an upper bulkhead, and further comprising a lower bulkhead spanning a lower portion within said main body member, said lower bulkhead having a plurality of near-vertical orifices therethrough wherein said tubular members pass convergently downward through said bulkheads.

6. The golf club playing bag, cart and travel container of claim 5, further comprising an intermediate bulkhead spanning an intermediate portion within said main body member, said intermediate bulkhead having a plurality of near-vertical orifices wherein said tubular members pass convergently downward therethrough.

7. The golf club playing bag, cart and travel container of claim 2, wherein said bulkhead spanning the upper opening is configured to retain the golf club heads thereabove, and further comprising a compressible foam member in said cover for embracing and retaining each said club head when said cover is in the closed position.

8. The golf club playing bag, cart and travel container of claim 1, wherein said shell is molded of a semi-rigid resilient synthetic material.

9. The golf club playing bag, cart and travel container of claim 1, wherein said carriage is configured to move forwardly from a retracted position wherein said wheels lie in opposed generally parallel upright planes within said shell to an extended position wherein said wheels are positioned forwardly from said shell with increased lateral separation therebetween, each said wheel further configured to swivel about a said oblique axis to a playing position having a generally horizontal axis of rotation.

10. The travelling golf container/cart of claim 1, wherein the shell rests on an upper portion of said struts when said carriage is fully opened.

11. The integrated golf club playing bag, cart and travel container of claim 1, further comprising insets formed in said shell adjacent said upper portions of said struts to cup and hold said struts in said fully open position.

12. A travelling golf container/cart, comprising:

a durable orthorhombic hard shell having an outer planar surface and an inner surface, said shell molded of synthetic material and including a main body portion enclosing an interior, and a cover hinged thereto, said cover containing expanded foam shaped to accept and immobilize golf club heads when closed;

wheels operable between an extended working position and a retracted storage position;

apertures in said shell for enclosing retracted wheels therewithin;

wheeled articulated carriage means operable between an expanded operating position supporting the container/cart and a retracted position wherein said carriage means is contained within said shell surface;

recesses in said outer planar surface for enclosing carriage means;

a plurality of spaced bulkheads formed of one of rigid and semirigid expanded foam and mounted in the interior of the shell, each said bulkhead formed with an array of generally vertical spaced apertures therethrough, said bulkheads including an upper bulkhead abutting each inside lateral surface of said shell and a lower bulkhead with reduced width, each said bulkhead having apertures generally converging downwardly, each said bulkhead having a vertical depth of at least about one third of the horizontal dimension thereof;

a plurality of non-parallel tubular golf club shaft receivers, each said receiver passing through an aperture in each of said spaced bulkheads, and affixed thereto; and handle means.

13. A wheeled carriage for a golf bag, comprising:

a pair of generally upright spaced elongate struts joined by connecting means, each said strut having an upper end pivotally joinable at spaced-apart locations to a generally horizontal rod attachable to an upper portion of the golf bag, each said strut having a lower end portion, said lower ends of said struts swingable forwardly from said golf bag and swingable laterally from a retracted position within said golf bag to a fully opened position for supporting said golf bag; and a pair of wheels rotatably attached to a pair of swivel arms, each said swivel arm being attached to one of said struts whereby each said wheel is swivelably attached to a lower end portion of a respective attached strut about an axis oblique to said attached strut whereby swiveling of both wheels simultaneously moves said wheels from a position extending rearwardly of said struts for storage within said golf bag during the retracted position to the fully opened position with the wheels extending forwardly of said struts, the span distance therebetween being extended while in the fully opened position;

said connecting means comprising means for retaining said struts at said fully opened position.

14. The wheeled carriage of claim 13, wherein said wheels attached to said struts in said fully opened position have substantially coaxial rotational axes.

15. The wheeled carriage of claim 13, wherein said wheels attached to said struts have substantially coaxial rotational axes in both said fully opened position and said retracted position.

16. A Lightweight golf bag, comprising:

a hard shell of lightweight thin material;

one or more lightweight foamed plastic bulkheads including an uppermost and lowermost bulkheads, said bulkheads vertically spaced-apart within said shell;

an array of holes in each said bulkhead;

an array of non-parallel tubular golf club shaft receivers placed within said holes in said bulkheads, wherein lowermost bulkhead is smaller than the uppermost bulkhead and said receivers converge downwardly into the lowermost bulkhead through said holes;

extendible wheel carriage means including a pair of wheels, the wheel carriage means being collapsible to a folded position within an interior of the hard shell with the pair of wheels being fully received within a pair of recessed compartments formed between respective lateral sides of said lowermost bulkhead and interior lateral walls of said hard shell; and handle means attached to said bag.

17. The lightweight golf bag of claim 16, wherein each said bulkhead has a vertical dimension and a horizontal dimension, said vertical dimension being at least one-third the horizontal dimension.

18. The lightweight golf bag of claim 16, wherein said tubular golf club shaft receivers are cemented to said bulkheads.

* * * * *